US008282142B2

(12) United States Patent
Fannon

(10) Patent No.: US 8,282,142 B2
(45) Date of Patent: Oct. 9, 2012

(54) LATCH RELEASE SYSTEM FOR A DOOR ASSEMBLY OF A VEHICLE

(75) Inventor: Joseph P. Fannon, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 572 days.

(21) Appl. No.: 12/277,569

(22) Filed: Nov. 25, 2008

(65) Prior Publication Data

US 2010/0127516 A1 May 27, 2010

(51) Int. Cl.
*E05B 3/00* (2006.01)

(52) U.S. Cl. ..... 292/336.3; 292/DIG. 22; 292/DIG. 27; 292/DIG. 65

(58) Field of Classification Search ..... 292/336.3, 292/DIG. 22, DIG. 65, DIG. 27; 16/412, 16/413

See application file for complete search history.

(56) References Cited

U.S. PATENT DOCUMENTS

| | | | | | |
|---|---|---|---|---|---|
| 3,993,338 | A * | 11/1976 | Cherbourg et al. | ..... | 292/336.3 |
| 4,382,622 | A * | 5/1983 | Ishikawa | ..... | 292/216 |
| 4,573,723 | A * | 3/1986 | Morita et al. | ..... | 292/336.3 |
| 5,584,516 | A * | 12/1996 | Cetnar | ..... | 292/336.3 |
| 6,042,159 | A | 3/2000 | Spitzley et al. | | |
| 6,070,923 | A * | 6/2000 | Tanimoto et al. | ..... | 292/336.3 |
| 6,363,577 | B1 * | 4/2002 | Spitzley | ..... | 292/336.3 |
| 6,565,134 | B1 * | 5/2003 | Stuart et al. | ..... | 292/336.3 |
| 6,575,508 | B2 * | 6/2003 | Stuart et al. | ..... | 292/336.3 |
| 6,749,236 | B2 * | 6/2004 | Nomura et al. | ..... | 292/336.3 |
| 7,111,880 | B2 * | 9/2006 | Saitoh | ..... | 292/336.3 |
| 7,232,164 | B2 * | 6/2007 | Lee | ..... | 292/336.3 |
| 2003/0019261 | A1 * | 1/2003 | Wittwer | ..... | 70/257 |

FOREIGN PATENT DOCUMENTS

DE 102007049900 A1 4/2008

* cited by examiner

*Primary Examiner* — Carlos Lugo
*Assistant Examiner* — Alyson M Merlino
(74) *Attorney, Agent, or Firm* — Quinn Law Group, PLLC

(57) ABSTRACT

A latching system includes a handle, a latch, a release rod, an arm portion, and a finger portion. The handle is attached to the door assembly and includes an escutcheon and a grip portion movable relative to the escutcheon between a first position, a second position, and a third position. The latch is attached to the door assembly and the release rod extends from the latch. The arm portion rotates relative to the escutcheon in response to moving the grip portion. The finger portion pivotally extends from the arm portion to an engagement member that is disengaged from the release rod when the pull grip is in the first position, engages the release rod when the pull grip is in the second position, and moves the release rod away from the handle and toward the latch to operate the latch when the pull grip is in the third position.

10 Claims, 2 Drawing Sheets

FIG. 3
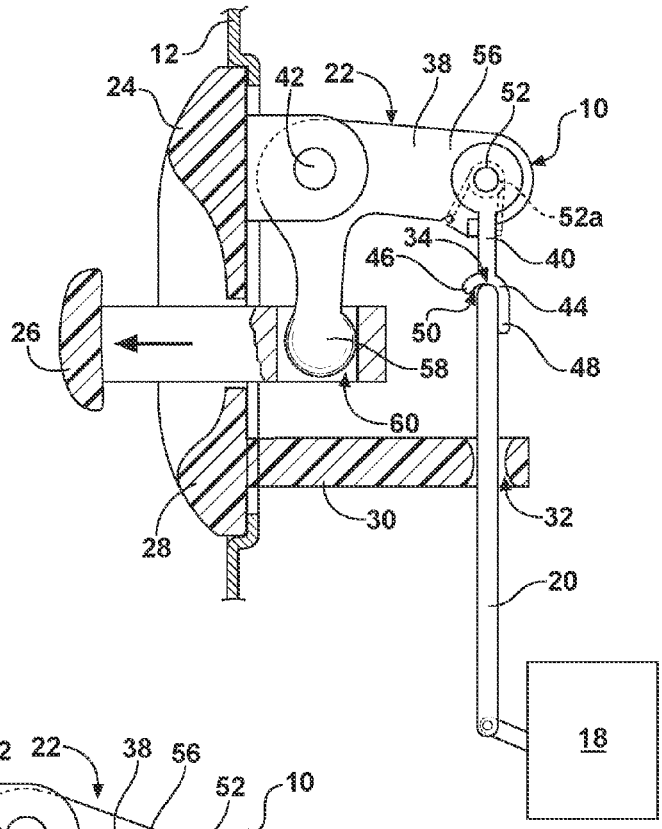
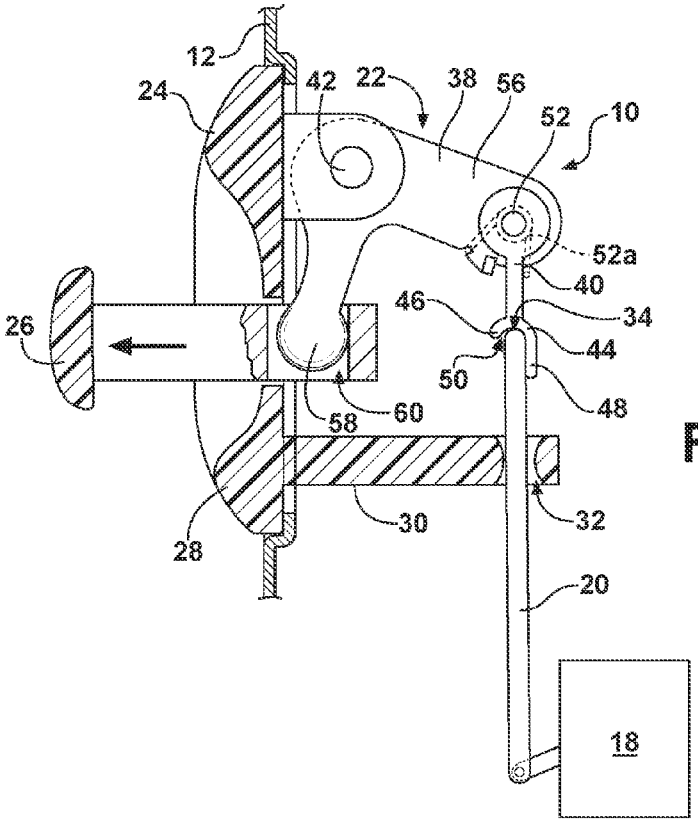
FIG. 4

LATCH RELEASE SYSTEM FOR A DOOR ASSEMBLY OF A VEHICLE

TECHNICAL FIELD

The present invention relates to a latch release system for a door assembly of a vehicle.

BACKGROUND OF THE INVENTION

A typical latching system for a door assembly of a vehicle includes a handle, a latch, and a release rod. The handle and the latch may be operatively attached to the door in spaced relationship and the release rod may extend to interconnect the handle to the latch. When the handle is operated, the handle pushes directly onto the release rod. The release rod may, in turn, push directly onto the latch to unlatch the door from the body of the vehicle. Likewise, when the handle is released the handle pulls backward on the release rod such that the latch is no longer being pushed upon by the release rod. Therefore, the handle is interconnected with the latch even when the handle is not being operated.

SUMMARY OF THE INVENTION

An articulating arm assembly decouples a handle from a release rod that extends from a latch within a door assembly of a vehicle. The articulating arm assembly includes an arm portion, a finger portion and an engagement member. The arm portion is configured to pivotally extend from an escutcheon of the handle. The finger portion pivotally extends from the arm portion. The engagement member extends from the finger portion. The engagement member is configured to engage the release rod to operatively interconnect the handle and the latch when the handle is in one of a second position and a third position. The engagement member is configured to disengage the release rod to operatively disconnect the handle from the latch when the handle is in a first position.

A latching system for a door assembly includes a handle, a latch, a release rod, and an articulating arm assembly. The handle is configured for operative attachment to the door assembly. The latch is configured for operative attachment to the door assembly, in spaced relationship to the handle. The release rod operatively extends from the latch such that moving the release rod relative to the handle operates the latch. The articulating arm assembly is pivotally attached to the handle. The articulating arm assembly engages the release rod to operatively interconnect the handle and the latch when the handle is in one of a second position and a third position. The articulating arm assembly disengages the release rod to operatively disconnect the handle from the latch when the handle is in a first position.

A latching system is configured for latching and unlatching a door assembly. The latching system includes a handle, a latch, a release rod, an arm portion, and a finger portion. The handle includes an escutcheon and a grip portion. The escutcheon is configured for operative attachment to the door assembly. The grip portion is movable relative to the escutcheon between a first position, a second position, and a third position. The escutcheon defines an alignment feature. The latch is configured for operative attachment to the door assembly. The release rod operatively extends from the latch and through the alignment feature such that moving the release rod operates the latch. The arm portion is operatively connected to the grip portion and is pivotally connected to the escutcheon. The finger portion pivotally extends from the arm portion to an engagement member. The engagement member is disengaged from the release rod to prevent operation of the latch when the pull grip is in the first position. The engagement member engages the release rod when the pull grip is in the second position. The engagement member presses an end of the release rod away from the handle and toward the latch to operate the latch when the pull grip is in the third position.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Referring now to the figures, which are exemplary embodiments and wherein like elements are numbered alike:

FIG. 3 is a schematic partial cross-sectional view of the latching system having the handle in a second position with the articulating arm assembly engaging the release rod extending from the latch; and FIG. 4 is a schematic partial cross-sectional view of the latching system having the handle in a third position with the articulating arm assembly engaging and pressing downward on the release rod to operate the latch to unlatch the door assembly from the body of the vehicle.

DESCRIPTION OF THE PREFERRED EMBODIMENTS

Figure 1:
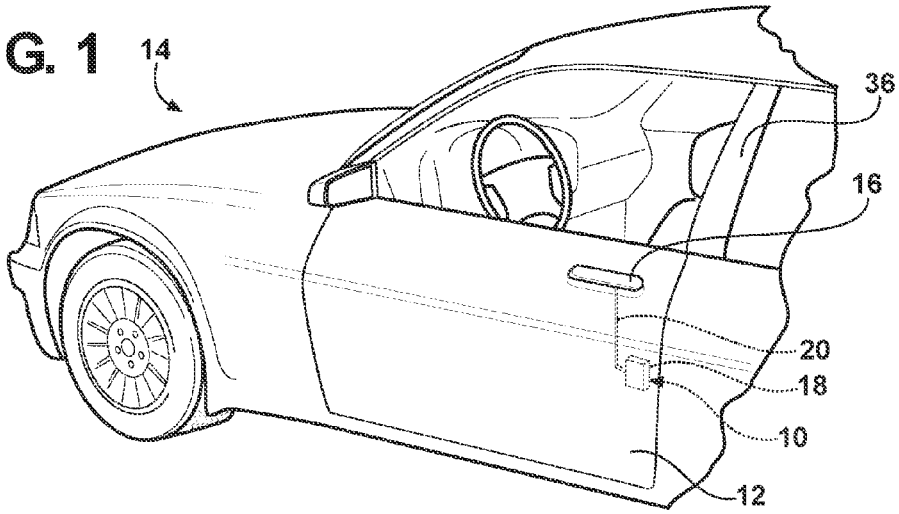
FIG. 1 is a partial perspective view of a vehicle having a body, a door assembly, and a latching system for latching and unlatching the door assembly to the body.

Referring to the drawings, wherein like reference numbers refer to like components, FIG. 1 shows a latching system 10 for a door assembly 12 of a vehicle 14. The latching system 10 includes a handle 16, a latch 18, a release rod 20, and an articulating arm assembly 22.

Figure 2:
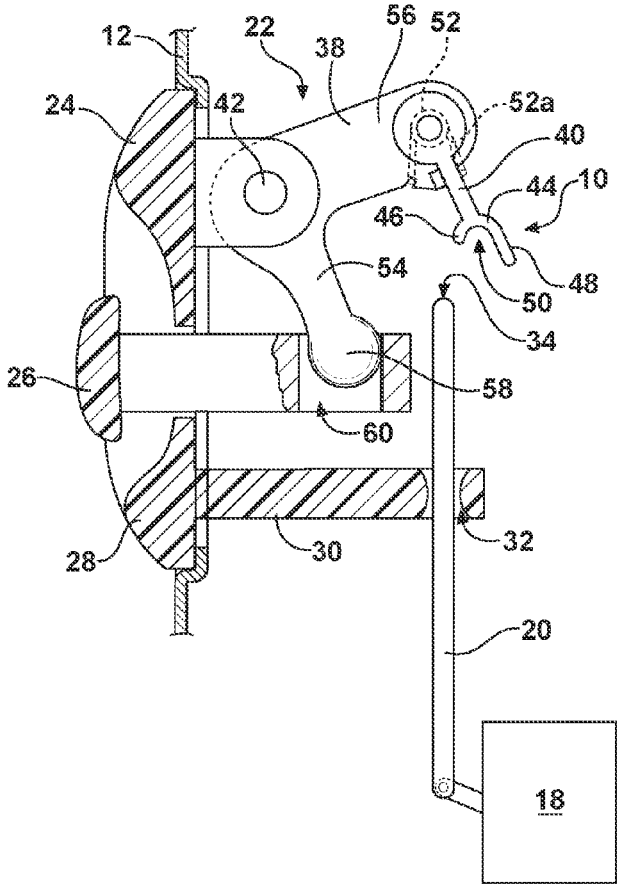
FIG. 2 is a schematic partial cross-sectional view of the latching system having a handle in a first position with an articulating arm assembly disengaged from a release rod extending from a latch.

The handle 16 is configured for operative attachment to the door assembly 12. Referring to FIG. 2, the handle 16 includes an escutcheon 24 and a grip portion 26. The escutcheon 24 is attached to the door assembly 12. The escutcheon 24 may include a face portion 28 and a guide portion 30 that extends from the face portion 28. The face portion 28 may be configured to attach to the door assembly 12. The guide portion 30 extends generally perpendicularly away from the face portion 28 and may define a channel 32 that extends therethrough.

The latch 18, shown schematically in FIG. 3, may be operatively attached to the door assembly 12. Movement of the release rod 20 away from the handle 16, i.e., toward the latch 18, operates the latch 18 to unlatch the door assembly 12 from the body 36 of the vehicle 14. The release rod 20 operatively extends from the latch 18 and through the channel 32 to an end 34. The channel 32 within the guide portion 30 keeps the release rod 20 in alignment between the latch 18 and the articulating arm assembly 22. The latch 18 operates to unlatch the door assembly 12 from the body 36 of the vehicle 14 by moving the release rod 20 away from the handle 16, i.e., toward the latch 18. The articulating arm assembly 22 may be pivotally attached to the handle 16. To operate the latch 18, the articulating arm assembly 22 presses down on the end 34 of the release rod 20, i.e., presses the release rod 20 toward the latch 18, the end 34 of the release rod 20 is prevented from rotating relative to the handle 16 or the latch 18.

The grip portion 26 is movable relative to the escutcheon 24 and the door assembly 12 between a first position, through a second position, and to a third position. The first position of the grip handle 16, as shown in FIG. 2, corresponds to the articulating arm assembly 22 being completely disengaged from the release rod 20. The second position of the grip portion 26, as shown in FIG. 3, corresponds to the articulating arm assembly 22 initially engaging the release rod 20. The third position of the grip portion 26, as shown in FIG. 4, corresponds to the latch 18 being operated to unlatch the door from the body 36 of the vehicle 14.

The articulating arm assembly 22 may be pivotally attached to the handle 16 and configured to rotate into engagement with the end 34 of the release rod 20 in response to the grip portion 26 moving to the second position. Therefore, engagement of the articulating arm assembly 22 with the release rod 20 operatively interconnects the handle 16 with the latch 18. When the grip portion 26 moves from the second position to the third position, the articulating arm assembly 22 continues to rotate relative to the escutcheon 24 and presses generally downward on the end 34 of the release rod 20 to operate the latch 18. Likewise, when the grip portion 26 is returned to the first position, the articulating arm assembly 22 disengages from the end 34 of the release rod 20 to operatively disconnect the handle 16 from the latch 18. This means that the articulating arm assembly 22 only engages the release rod 20 when the grip portion 26 is in the second and/or third positions.

The articulating arm assembly 22 includes an arm portion 38 and a finger portion 40. The arm portion 38 is pivotally attached to the escutcheon 24 of the handle 16 at a pivot 42. The finger portion 40 extends from the arm portion 38. The finger portion 40 may extend from the second section 56 in spaced relationship to the pivot 42. An engagement member 44 may extend from the finger portion 40 to engage the release rod 20 and operatively interconnect the handle 16 and the latch 18 when the handle 16 is in the second and/or the third positions. Likewise, the engagement member 44 disengages the release rod 20 to operatively disconnect the handle 16 and the latch 18 when the handle 16 is in the first position. The engagement member 44 may include a first leg 46 and a second leg 48 with a groove 50 defined between the first leg 46 and the second leg 48. The engagement member 44 may be generally J-shaped such that the first leg 46 is shorter than the second leg 48 and the groove 50 opens toward the end 34 of the release rod 20. The channel 32 may be generally U-shaped. However, it should be appreciated that the engagement member 44 may be any other shape known to those skilled in the art. The engagement member 44 rotates with the arm portion 38 until the end 34 of the release rod 20 enters the channel 32 and the second leg 48, i.e., the longer leg, catches on a side of the release rod 20.

A biasing device 52 may be disposed between the finger portion 40 and the second section 56 of the arm portion 38 to pivotally bias the finger portion 40 into an initial position, as shown in FIGS. 2 and 3, when the engagement member 44 is not pressing down on the end 34 of the release rod 20, as shown in FIG. 4. Therefore, the biasing device 52 biases the finger portion 40 into the initial position when the engagement member 44 is disengaged from the end 34 of the release rod 20. As the grip portion 26 moves the engagement member 44 of the articulating arm assembly 22 from the first position to the second position, and into engagement with the release rod 20, the release rod 20 causes the engagement member 44 to rotate relative to the arm portion 38. This rotation allows the finger portion 40 to remain in alignment with the release rod 20 as the engagement member 44 presses downward on the release rod 20. This direct alignment means that the rotational motion of the articulating arm assembly 22 is translated into directly pressing down on the release rod 20 to transmit a force of the grip portion 26 into the release rod 20 to unlatch the latch 18 of the door assembly 12 from the body 36 of the vehicle 14. The engagement member 44 rotates with the arm portion 38 until the end 34 of the release rod 20 enters the channel 32 and the second leg 48, i.e., the longer leg, catches on a side of the release rod 20. As the arm portion 38 rotates, the finger portion 40 and the engagement member 44 rotate relative to the arm portion 38, straining the biasing device 52 such that the biasing device 52 "winds up" and exerts a downward force on the release rod 20 toward the latch 18. The biasing device 52 may be a spring, i.e., a torsional spring 52*a* and the like. It should be appreciated, however that the biasing device 52 is not limited to being a spring as any other biasing device 52 known to those skilled in the art may also be used.

The arm portion 38 includes a first section 54 and a second section 56 that extends from the first section 54. The first section 54 and the second section 56 may be generally L-shaped. The pivot 42 may be disposed where the first section 54 and the second section 56 intersect along the arm portion 38 such that the arm portion 38 pivots about the pivot 42, relative to the escutcheon 24. The first section 54 of the arm portion 38 is operatively connected to the grip portion 26. More specifically, the first section 54 includes a contact member 58 and the grip portion 26 defines a cavity 60. The contact member 58 of the first section 54 is operatively disposed in the cavity 60. Therefore, as the grip portion 26 moves between the second position and the first position, the grip portion 26 moves the contact member 58. The contact member 58, in turn, causes the arm portion 38 to rotate about the pivot 42. Rotation of the arm portion 38 about the pivot 42 also moves the finger portion 40 into engagement and disengagement with the release rod 20, respectively. In one embodiment, the contact member 58 is spherical in shape. The spherical shape of the contact member 58 prevents binding between the contact member 58 and the grip portion 26 as the grip portion 26 is moved between the first, second, and third positions. It should be appreciated, however, that the invention is not limited to having a contact member 58 that is spherical in shape as a contact member 58 having any cam surface known to those skilled in the art may also be used.

While the best modes for carrying out the invention have been described in detail, those familiar with the art to which this invention relates will recognize various alternative designs and embodiments for practicing the invention within the scope of the appended claims.

The invention claimed is:

1. A latching system for a door assembly of a vehicle, said latching system comprising:

a handle configured for operative attachment to the door assembly;

a latch, in spaced relationship to said handle, and configured for attachment to the door assembly and operative to latch and unlatch the door assembly to the vehicle;

a release rod operatively extending from said latch such that moving said release rod relative to said handle operates said latch;

an articulating arm assembly pivotally attached to said handle;

wherein said handle includes an escutcheon and a grip portion movable relative to said escutcheon and said articulating arm assembly is pivotally attached to said escutcheon;

wherein said escutcheon defines a channel extending therethrough and said release rod extends through said channel such that said release rod is oriented with respect to said articulating arm assembly; and wherein said articulating arm assembly engages said release rod to operatively interconnect said handle and said latch when said handle is in one of a second position and a third position and said articulating arm assembly disengages said release rod to operatively disconnect said handle and said latch when said handle is in a first position.

2. A latching system, as set forth in claim 1, wherein said articulating arm assembly includes an arm portion and a finger portion and said arm portion is pivotally attached to said handle and said finger portion engages said release rod to operatively interconnect said handle and said latch when said handle is in one of said second position and said third position, and said finger portion disengages said release rod to operatively disconnect said handle and said latch when said handle is in said first position.

3. A latching system, as set forth in claim 2, wherein said arm portion includes a first section and a second section extending from said first section to form a general L-shape;

wherein said finger portion extends from said second section;

wherein said first section is movably connected to said grip portion such that said finger portion engages said release rod to operatively interconnect said handle and said latch when said grip portion is in one of said second position and said third position;

wherein said first section is movably connected to said grip portion such that said finger disengages said release rod to disconnect said handle from said latch when said grip portion is in said first position.

4. A latching system, as set forth in claim 3, wherein said grip portion defines a cavity and said first section is operatively disposed in said cavity such that said arm portion and said finger portion rotate relative to said escutcheon in response to moving said grip portion to one of said second position and said third position to operatively interconnect said handle and said latch, and to said first position to disengage said handle from said latch.

5. A latching system, as set forth in claim 4, wherein said first section includes a contact member and said contact member is operatively disposed in said cavity such that moving said grip portion moves said contact member such that said arm portion rotates about said pivot and said finger portion moves relative to said release rod.

6. A latching system, as set forth in claim 3, wherein said articulating arm assembly further includes a joint disposed between said arm portion and said finger portion such that said finger portion pivots relative to said arm portion as said finger portion engages said release rod to operatively interconnect said handle and said latch when said grip portion is in said second position and to disengage said handle from said latch when said grip portion is in said first position.

7. A latching system, as set forth in claim 1, wherein said articulating arm assembly further includes an engagement member extending from said finger portion such that said engagement member engages said release rod to operatively interconnect said handle and said latch when said handle is in said second position and said engagement member disengages said release rod to operatively disconnect said handle and said latch when said handle is in said first position.

8. A latching system, as set forth in claim 7, wherein said engagement member includes a first leg and a second leg defining a groove therebetween such that an end of said release rod extends into said groove and at least one of said legs engage said release rod to operatively interconnect said handle and said latch when said handle is in one of said second position and said third position and said engagement member disengages said release rod to operatively disconnect said handle from said latch when said handle is in said first position.

9. A latching system, as set forth in claim 8, wherein said engagement member is generally J-shaped such that said first leg is shorter than said second leg and said groove opens toward said end of said release rod.

10. A latching system configured for latching and unlatching a door assembly, said latching system comprising:

a handle having an escutcheon configured for operative attachment to the door assembly and a grip portion movable relative to said escutcheon between a first position, a second position, and a third position;

wherein said escutcheon defines a channel;

a latch configured for operative attachment to the door assembly;

a release rod operatively extending from said latch and through said channel such that moving said release rod operates said latch;

an arm portion operatively connected to said grip portion and pivotally connected to said escutcheon;

wherein said arm portion includes a first section and a second section with a pivot disposed between said first section and said second section, wherein said pivot is configured for pivotal attachment to the escutcheon of the handle;

a finger portion pivotally extending from said second section of said arm portion to an engagement member;

wherein said engagement member is disengaged from said release rod to prevent operation of said latch when said grip portion is in said first position, said engagement member engages said release rod when said grip portion is in said second position, and said engagement member presses an end of said release rod away from said handle and toward said latch to operate said latch when said grip portion is in said third position; and a biasing device operatively interconnecting said second section of said arm portion and said finger portion.

* * * * *